US010808433B2

(12) United States Patent
Im et al.

(10) Patent No.: US 10,808,433 B2
(45) Date of Patent: Oct. 20, 2020

(54) TAILGATE OPENING AND CLOSING DEVICE FOR VEHICLE

(71) Applicants: Hyundai Motor Company, Seoul (KR); Kia Motors Corporation, Seoul (KR); Pyeong Hwa Automotive Co., Ltd., Daegu (KR)

(72) Inventors: Yong Hyuck Im, Seoul (KR); Mun Bae Tak, Daegu (KR)

(73) Assignees: Hyundai Motor Company, Seoul (KR); Kia Motors Corporation, Seoul (KR); Pyeong Hwa Automotive Co., Ltd., Daegu (KR)

( * ) Notice: Subject to any disclaimer, the term of this patent is extended or adjusted under 35 U.S.C. 154(b) by 595 days.

(21) Appl. No.: 15/643,176

(22) Filed: Jul. 6, 2017

(65) Prior Publication Data

US 2018/0171679 A1 Jun. 21, 2018

(30) Foreign Application Priority Data

Dec. 19, 2016 (KR) ..... 10-2016-0173259

(51) Int. Cl.

| | |
|---|---|
| ***E05B 81/20*** | (2014.01) |
| ***E05B 79/20*** | (2014.01) |
| ***E05B 81/16*** | (2014.01) |
| ***E05B 85/24*** | (2014.01) |
| ***E05B 83/16*** | (2014.01) |

(Continued)

(52) U.S. Cl.

CPC ..... *E05B 81/20* (2013.01); *E05B 79/20* (2013.01); *E05B 81/06* (2013.01); *E05B 81/16* (2013.01); *E05B 81/34* (2013.01); *E05B 81/66* (2013.01); *E05B 81/90* (2013.01); *E05B 83/16* (2013.01); *E05B 83/18* (2013.01); *E05B 85/24* (2013.01); *E05Y 2900/546* (2013.01); *Y10S 292/23* (2013.01); *Y10S 292/29* (2013.01); *Y10S 292/42* (2013.01); *Y10S 292/43* (2013.01);

(Continued)

(58) Field of Classification Search

CPC ..... Y10T 292/1082; Y10T 292/1047; Y10T 292/0908; E05B 81/20; E05B 81/06; E05B 81/16; E05B 81/30; E05B 81/66; E05B 81/68; E05B 81/90; E05B 81/04; E05B 81/42; E05B 83/18; Y10S 292/29; Y10S 292/42; Y10S 292/23; Y10S 292/65; Y10S 292/43

See application file for complete search history.

(56) References Cited

U.S. PATENT DOCUMENTS 6,648,380 B1 * 11/2003 Szablewski et al. ..... 292/201
7,946,634 B2 * 5/2011 Bendel ..... E05B 81/14 292/201

(Continued)

FOREIGN PATENT DOCUMENTS

CN 103375052 A 10/2013
JP 2008-13932 A 1/2008

(Continued)

*Primary Examiner* — Kristina R Fulton
*Assistant Examiner* — Faria F Ahmad
(74) *Attorney, Agent, or Firm* — Morgan, Lewis & Bockius LLP

(57) ABSTRACT

A tailgate opening and closing device for a vehicle may include a main gear disposed at a base, to be driven by a drive motor, and a lever assembly having a plurality of links operated by the main gear, for locking or unlocking of a striker by a claw.

14 Claims, 13 Drawing Sheets

(51) Int. Cl.

| | |
|---|---|
| ***E05B 81/90*** | (2014.01) |
| ***E05B 81/06*** | (2014.01) |
| ***E05B 81/34*** | (2014.01) |
| ***E05B 83/18*** | (2014.01) |
| ***E05B 81/66*** | (2014.01) |

(52) U.S. Cl.
CPC ..... *Y10S 292/65* (2013.01); *Y10T 292/0908* (2015.04); *Y10T 292/1047* (2015.04); *Y10T 292/1082* (2015.04)

(56) References Cited

U.S. PATENT DOCUMENTS 9,945,164 B2 * 4/2018 Perkins ..... E05B 81/28
10,280,653 B2 * 5/2019 Estrada ..... E05B 81/28
2003/0116977 A1 * 6/2003 Erices ..... E05B 81/06 292/201
2004/0174021 A1 * 9/2004 Tensing ..... E05B 81/14 292/216
2005/0082842 A1 * 4/2005 Warmke ..... E05B 77/28 292/216
2008/0136196 A1 * 6/2008 Pecoul ..... E05B 85/243 292/215
2008/0271503 A1 * 11/2008 Buschmann ..... E05B 81/20 70/237
2010/0171320 A1 * 7/2010 Cumbo ..... E05B 81/14 292/200
2010/0171321 A1 * 7/2010 Akizuki et al. ..... E05B 77/26 292/200
2011/0316293 A1 * 12/2011 Luschper et al. ..... E05B 79/20 292/195
2012/0153641 A1 * 6/2012 Watanabe ..... E05B 81/14 292/98
2012/0181798 A1 * 7/2012 Margheritti et al. ... E05B 77/32 292/200
2013/0015670 A1 * 1/2013 Perkins ..... E05B 81/28 292/97
2014/0049056 A1 * 2/2014 Scholz et al. ..... E05B 81/04 292/200
2014/0175813 A1 * 6/2014 Margheritti et al. ... E05B 77/34 292/201
2014/0252783 A1 * 9/2014 Yokota ..... E05B 81/20 292/196
2015/0042108 A1 * 2/2015 Okawa et al. ..... E05B 85/00 292/194
2015/0048632 A1 * 2/2015 Menke ..... E05B 77/287 292/336.3
2015/0137530 A1 * 5/2015 Vazquez ..... E05B 81/16 292/200
2015/0240534 A1 * 8/2015 Kuriyama et al. ..... E05B 81/06 292/201
2015/0252593 A1 * 9/2015 Milne et al. ..... E05B 81/54 174/541
2015/0284977 A1 * 10/2015 Barmscheidt ..... E05B 79/10 292/200
2015/0300052 A1 * 10/2015 Barmscheidt ..... E05B 79/10 292/201
2015/0300053 A1 * 10/2015 Milne et al. ..... E05B 81/36 74/89.14
2015/0308156 A1 * 10/2015 Hunt et al. ..... E05B 47/023 292/201
2015/0308163 A1 * 10/2015 Tomaszewski ..... E05B 77/28 292/196
2016/0010364 A1 * 1/2016 Hanaki et al. ..... E05B 83/40 292/21
2016/0010365 A1 * 1/2016 Hanaki et al. ..... E05B 81/14 292/21
2016/0017645 A1 * 1/2016 Tomaszewski et al. ..... E05B 85/01 292/240
2016/0090131 A1 * 3/2016 Lim ..... E05C 5/02 292/58
2016/0153217 A1 * 6/2016 Mazal ..... E05B 81/15 292/200
2016/0362915 A1 * 12/2016 Tomaszewski ..... E05B 79/08
2016/0362916 A1 * 12/2016 Tomaszewski ..... E05B 81/76
2017/0074007 A1 * 3/2017 Chevalier ..... E05B 81/14
2017/0167170 A1 * 6/2017 Seo et al. ..... E05B 79/08
2018/0080264 A1 * 3/2018 Ichinose ..... E05B 77/265
2018/0080266 A1 * 3/2018 Lebsak ..... E05B 85/243
2018/0163439 A1 * 6/2018 Patane ..... E05B 81/20
2018/0171677 A1 * 6/2018 Im ..... E05B 81/14
2018/0171680 A1 * 6/2018 Hunt ..... E05B 81/20
2018/0171681 A1 * 6/2018 Hunt ..... E05B 81/14
2018/0274268 A1 * 9/2018 Suholutskaja ..... E05B 77/245
2018/0291657 A1 * 10/2018 Strole ..... E05B 85/26
2018/0328086 A1 * 11/2018 Barmscheidt ..... E05B 77/26
2018/0347239 A1 * 12/2018 Im ..... E05B 81/20
2018/0347240 A1 * 12/2018 Jeong, II ..... E05B 79/20
2019/0078356 A1 * 3/2019 Reddmann ..... E05B 77/06

FOREIGN PATENT DOCUMENTS

KR 10-1273515 B1 6/2013
KR 10-1565683 B1 11/2015
KR 10-2016-0038917 A 4/2016
WO WO-2018030556 A2 * 2/2018 ..... E05B 81/06

* cited by examiner

TAILGATE OPENING AND CLOSING DEVICE FOR VEHICLE

CROSS-REFERENCE(S) TO RELATED APPLICATIONS

The present application claims priority to Korean Patent Application No. 10-2016-0173259, filed on Dec. 19, 2016, the entire contents of which is incorporated herein for all purposes by this reference.

BACKGROUND OF THE INVENTION

Field of the Invention

The present invention relates to a tailgate opening and closing device for a vehicle configured for controlling locked and unlocked states of a trunk using a single drive motor.

Description of Related Art

Generally, a vehicle has a tailgate configured to open or close a rear compartment of the vehicle for loading or unloading of goods into or from the vehicle, doors provided to open or close a passenger compartment of the vehicle for passengers to enter or exit the vehicle, and a hood provided to open or close an engine compartment of the vehicle. A door latch, which is engaged with or disengaged from a striker, is disposed at each of the tailgate, the doors, and the hood.

In the case of the door latch disposed to allow or prevent the opening of the tailgate, namely a tailgate latch, engagement thereof with the striker associated therewith is secured only when the user applies sufficient force to the tailgate upon closing the tailgate. When the user applies insufficient force to the tailgate upon closing the tailgate, the tailgate latch may be incompletely engaged with the striker and, as such, the tailgate may be incompletely closed, and the user may overlook incomplete closure of the tailgate. In the present case, the user may recognize incomplete closing of the tailgate through a signal displayed on a dashboard after sitting on a driver seat. In the present regard, there may be an inconvenience in that the user should check closure of the tailgate after moving to the tailgate. To solve such a problem, a power tailgate latch has been proposed. The power tailgate latch may achieve complete closing of the tailgate using a drive motor.

In conventional cases, however, two drive motors are disposed to transmit power in separate directions for closing and opening of the tailgate. For the present reason, an excessive increase in volume occurs and, as such, there may be a difficulty in positioning the drive motors in the interior of a vehicle body.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a tailgate opening and closing device for a vehicle, which is configured for not only achieving both functions of engagement and disengagement of a trunk latch, but also achieving emergency opening of a tailgate, using a single drive motor.

In accordance with an aspect of the present invention, the above and other objects can be accomplished by the provision of a tailgate opening and closing device for a vehicle including a base formed, at one side thereof, with a first insertion hole into or from which a striker can be inserted or withdrawn, a main gear disposed at the other side of the base while being rotatable by a drive motor, a claw rotatably disposed at a side of the first insertion hole of the base while being formed with a second insertion hole for receiving the striker, to lock the striker when the striker is inserted into the first insertion hole and the second insertion hole, and a lever assembly including an error lever disposed adjacent to the main gear and the claw while extending across between the main gear and the claw, a pawl lever for locking or unlocking the claw, and a release lever connected to the error lever and the pawl lever while being pivotable about a rotation shaft.

The drive motor may be mounted to the other side of the base at a position adjacent to the main gear. A worm gear may be provided at the drive motor to rotate the main gear during driving of the drive motor.

The lever assembly may further include a first link mounted to a rotation shaft, to which the main gear is mounted, wherein the first link rotates during rotation of the main gear, and a second link disposed to be engaged with or disengaged from the release lever at one end portion thereof while being pivotably coupled at the other end portion thereof to the first link, forming a coupler to pivot during rotation of the first link.

The release lever may be formed with an engagement groove recessed inwardly of the release lever at a surface of the release lever facing the second link, and the second link may be formed, at one side thereof, with an engagement protrusion to be engagable with the engagement groove wherein the engagement protrusion of the second link is selectively inserted into or engaged with, or disengaged from, the engagement groove in accordance with an operation of the second link carried out when the main gear rotates during driving of the drive motor.

The second link may be bent in the forward and rearward directions of the base at a center portion thereof, to form a stepped structure wherein the other end portion of the second link is lower than one end portion of the second link with respect to the base, and the other end portion of the second link is coupled to a front portion of the error lever.

The error lever may be formed with a first guide slit extending in a longitudinal direction of the error lever. A third link may be disposed at a rear side of the error lever. The third link may be bent from the release lever to a rotation shaft of the claw. The third link may be formed, at an inside thereof, with a second guide silt extending in a longitudinal direction of the third link. A cinching pin may be slidably coupled to the first guide slit of the error lever and the second guide slit of the third link, to extend through both the first guide slit and the second guide slit wherein the cinching pin slides along the first guide slit and the second guide slit during operation of the lever assembly, to pivot the release lever and to rotate the claw, locking or unlocking the striker.

The pawl lever may extend toward the claw while being pivotably mounted to the release lever at a lower side of the release lever, and the error lever may be pivotably mounted to the rotation shaft of the release lever while extending toward the release lever by a predetermined length and then being bent to extend transversally between the base and the claw wherein the pawl lever and the error lever pivot simultaneously about the rotation shaft while maintaining a constant distance therebetween, to lock or unlock the claw.

A first elastic member may be disposed at the rotation shaft of the release lever to always urge the release lever toward the claw.

The claw may have a first engagement step, a second engagement step and a third engagement step, which are formed along an external peripheral surface of the claw, wherein the pawl lever is engaged with the engagement steps in a stepwise manner, achieving primary locking, secondary locking or unlocking of the striker.

A second elastic member may be disposed at the rotation shaft of the claw to always urge the claw toward the first insertion hole.

An emergency handle may be rotatably disposed at the base above the release lever wherein, when the emergency handle rotates in accordance with an operation thereof, an end portion of the emergency handle presses the release lever, pivoting the release lever causing the pawl lever to be separated from the claw for unlocking of the striker.

The tailgate opening and closing device may further include a first detector disposed adjacent to the release lever, a second detector disposed adjacent to the main gear, a third detector disposed adjacent to the claw, and a controller configured for receiving positional signals from the first to third detectors, and controlling the drive motor based on the received positional signals. The controller may drive the drive motor upon determining the insertion of the striker into the first and second insertion holes, locking the striker inserted into the first and second holes.

The controller may operate the drive motor to perform a cinching operation, upon receiving signals from the first and second detectors, and may perform a control operation to complete the cinching operation upon subsequently receiving a signal from the first detector.

Upon receiving a signal from the third detector when separation of the striker from the claw has been completed, the controller may perform a control operation to return a set position of the main gear to an original position through the reverse rotation of the drive motor.

Upon receiving a tailgate opening signal, the controller may operate the drive motor to pivot the release lever, rotating the claw for unlocking of the striker.

The tailgate opening and closing device having the above-described configuration has a cinching-integrated power latch structure, in detail, a cinching-integrated structure using a link assembly with a main gear, and, as such, it may be possible to achieve a reduction in the number of constituent elements, a reduction in cost and a reduction in weight through structural simplification. In addition, by virtue of the cinching-integrated structure, loss of operating power is reduced. Since the main gear is rotatable in the clockwise direction (CW) or in the counterclockwise direction (CCW), bidirectional release may be achieved. As a result, an enhancement in product quality may be achieved.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
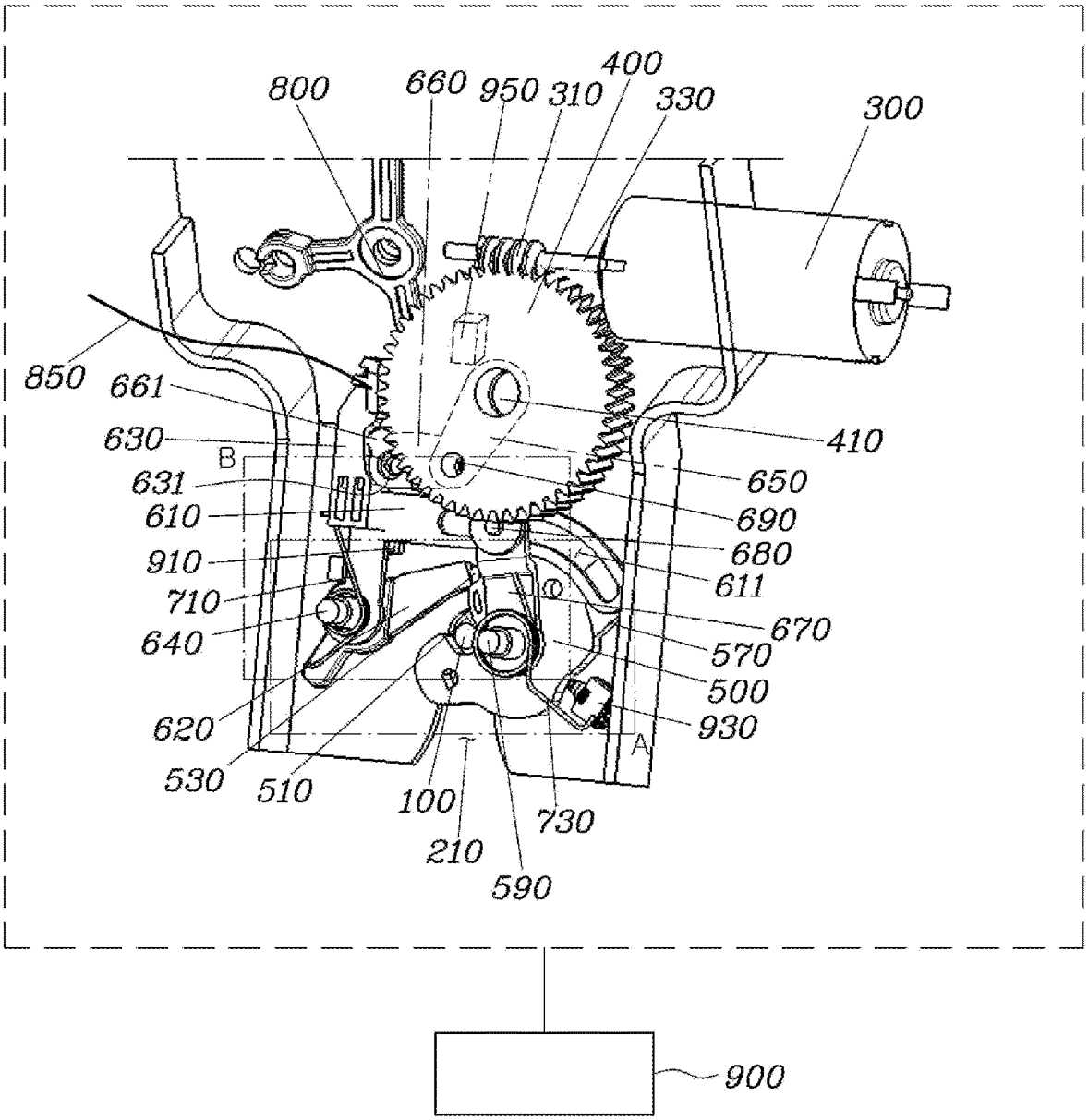
FIG. 1 is a view illustrating a tailgate opening and closing device for a vehicle according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which re illustrated in the accompanying drawings and described below. While the inventions(s) will be described in conjunction with exemplary embodiments, it will be understood that the present description is not intended to limit the invention(s) to those exemplary embodiments. On the contrary, the invention(s) is intended to cover not only the exemplary embodiments, but also various alternatives, modifications, equivalents and other embodiments, which may be included within the spirit and scope of the invention as defined by the appended claims.

Figure 2:
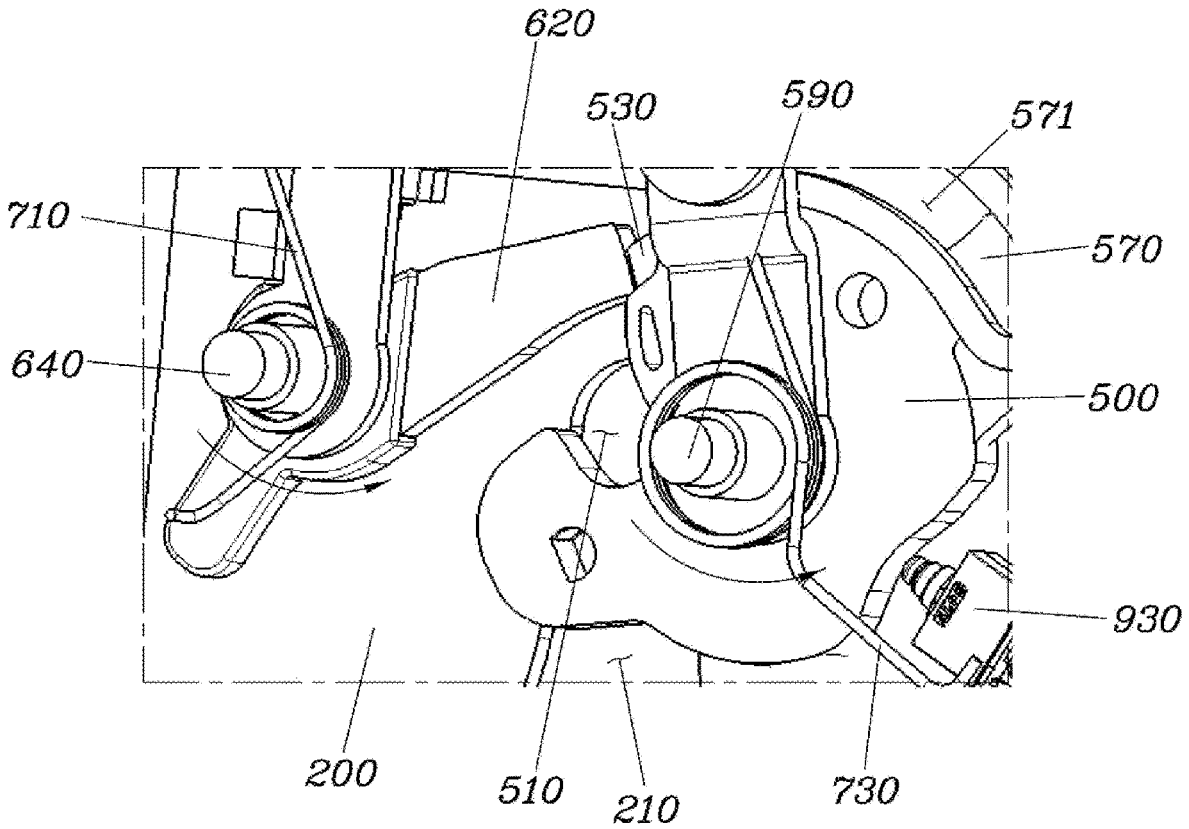
FIG. 2 is a view concretely illustrating a portion A of FIG. 1.
Figure 3:
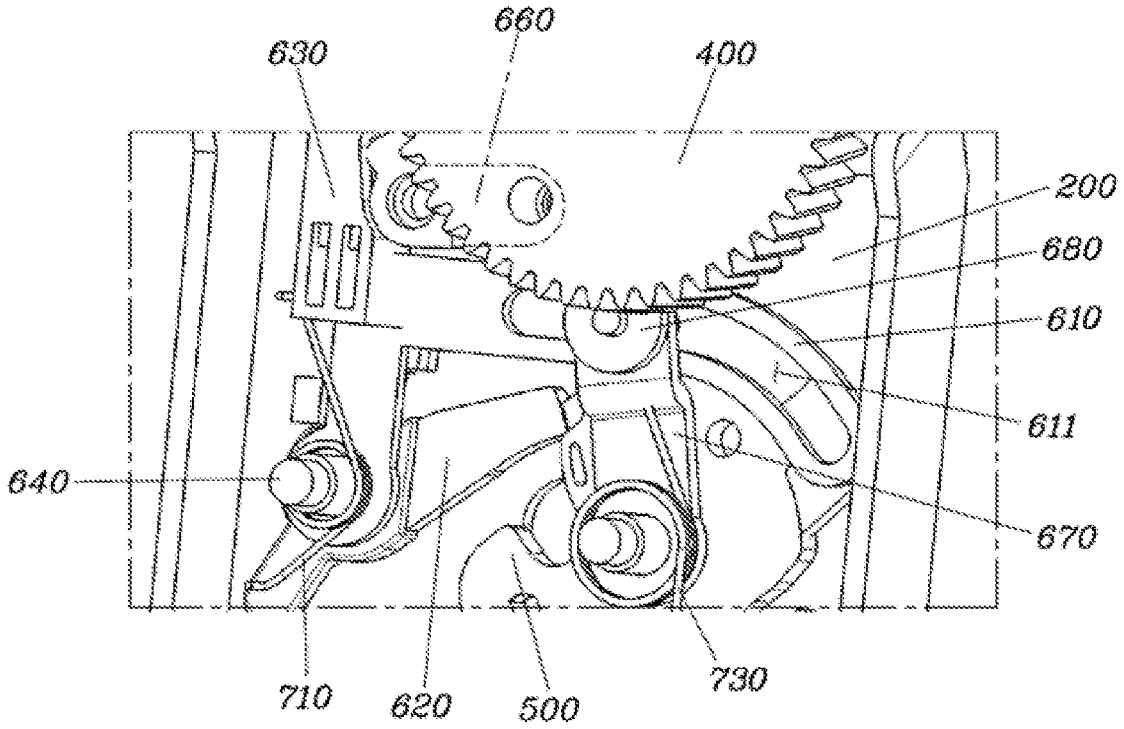
FIG. 3 is a view concretely illustrating a portion B of FIG. 1.

FIG. 1 is a view illustrating a tailgate opening and closing device for a vehicle according to an exemplary embodiment of the present invention. FIG. 2 is a view concretely illustrating a portion A of FIG. 1. FIG. 3 is a view concretely illustrating a portion B of FIG. 1.

As illustrated in FIG. 1, the tailgate opening and closing device according to the exemplary embodiment of the present invention includes a base 200 formed, at one side thereof, with a first insertion hole 210 into or from which a striker 100 can be inserted or withdrawn, a main gear 400 disposed at the other side of the base 200 while being rotatable by a drive motor 300, and a claw 500 rotatably disposed at the side of the first insertion hole 210 of the base 200 while being formed with a second insertion hole 510 for receiving the striker 100, to lock the striker 100 when the striker 100 is inserted into the first insertion hole 210 and the second insertion hole 510. The tailgate opening and closing device also includes a lever assembly 600 including an error lever 610 disposed adjacent to the main gear 400 and the claw 500 while extending across between the main gear 400 and the claw 500, a pawl lever 620 for locking or unlocking the claw 500, and a release lever 630 connected to the error lever 610 and the pawl lever 620 while being pivotable about a rotation shaft 640.

The base 200 has a plate shape and is bent at edge portions thereof wherein various elements may be seated inside the base 200. As described above, the first insertion hole 210 into or from which a striker 100 can be inserted or withdrawn, is formed at one side of the base 200. The first insertion hole 210 is formed to be recessed downwards when viewed in the drawings.

At the other side of the base 200, the main gear 400 is disposed to be rotatable in accordance with driving of the drive motor 300. The drive motor 300 includes a motor shaft 330, and a worm gear 310 formed at the motor shaft 330. During driving of the motor 300, accordingly, the motor shaft 330 rotates and, as such, the worm gear 310 rotates in accordance with rotation of the motor shaft 330. In accordance with rotation of the worm gear 310, the main gear 400 rotates.

In addition, first and second links 650 and 660, which are also included in the lever assembly 600, are connected to the main gear 400 while being pivotably connected to each other. The first link 650 is fixedly mounted to a rotation shaft 410, to which the main gear 400 is also fixedly mounted. Accordingly, the first link 650 rotates during rotation of the main gear 400. The first link 650 extends in a longitudinal direction corresponding to the radial direction of the rotation shaft 410. Since the first link 650 is fixed to the main gear 400, the first link 650 always has the same behavior as the main gear 400.

The second link 660 is disposed to be engaged with or disengaged from the release lever 630 at one end portion thereof while being pivotably coupled, at the other end portion thereof, to the first link 650 and, as such, a coupler 690 is formed. During rotation of the first link 650, the second link 660 pivots about the coupler 690. At one side of the second link 660, an engagement protrusion 661 protruding in the 10 o'clock direction (approximately 300°) is formed in the same plane as the second link 660. Accordingly, during driving of the drive motor 300, the main gear 400 rotates and, as such, the first link 650 fixed to the main gear 400 rotates. In accordance with rotation of the first link 650, the second link 660 pivots about the coupler 690.

In addition, as illustrated in FIG. 3, the second link 660 is bent in the forward and rearward directions of the base 200 at a center portion thereof and, as such, has a stepped structure. Accordingly, the other end portion of the second link 660 is lower than one end portion of the second link 660 with respect to the base 200. The other end portion of the second link 660 is coupled to a front portion of the error lever 610. The second link 660 is supported by a center portion of the release lever 630. As a result, the adjacent levers and links of the lever assembly 600 may precisely operate during operation of the lever assembly 600 conducted in accordance with driving of the drive motor 300 without interfering with one another.

As described above, the lever assembly 600 includes the error lever 610, the pawl lever 620, and the release lever 630. The release lever 630 extends in a longitudinal direction corresponding to a vertical direction of the base 200 at one side of the main gear 400 and claw 500 while being disposed to be pivotable about the rotation shaft 640. The release lever 630 is formed with an engagement groove 631 recessed inwardly of the release lever 630 at a surface of the release lever 630 facing the second link 660. The engagement protrusion 661 of the second link 660 is inserted into the engagement groove 631. Thus, the engagement protrusion 661 is selectively inserted into and engaged with, or disengaged from the engagement groove 631 in accordance with the operation of the second link 660. A first elastic member 710 is dispose at the rotation shaft 640, to always urge the release lever 630 toward the claw 500. The present operation will be described later with reference to the accompanying drawings.

The error lever 610 is disposed adjacent to the main gear 400 and the claw 500 while being pivotably mounted to the rotation shaft 640. The error lever 610 extends toward the release lever 630 by a predetermined length, and is then bent to extend transversally between the base 200 and the claw 500. The error lever 610 is formed with a first guide slit 611 extending in a longitudinal direction of the error lever 610, namely, a direction extending transversally between the main gear 400 and the claw 500.

A third link 670 is disposed at a rear side of the error lever 610. The third link 670 is bent from the release lever 630 to a rotation shaft 590 of the claw 500. The third link 670 is formed, at an inside thereof, with a second guide silt 671 extending in a longitudinal direction of the third link 670. A cinching pin 680 is slidably coupled to the first guide slit 611 of the error lever 610 and the second guide slit 671 of the third link 670, to extend through both the first guide slit 611 and the second guide slit 671. Accordingly, the cinching pin 680 slides along the first guide slit 611 and the second guide slit 671 during operation of the lever assembly 600 and, as such, the release lever 630 pivots, and the claw 500 rotates. As a result, the striker 100 is locked or unlocked.

The pawl lever 620 extends toward the claw 500 while being pivotably mounted to the release lever 630 at a lower side of the release lever 630. The pawl lever 620 and the error lever 610 pivot simultaneously while maintaining a constant distance therebetween, to lock or unlock the claw 500.

The claw 500 has a first engagement step 530, a second engagement step 550 and a third engagement step 570, which are formed along an external peripheral surface of the claw 500. As the pawl lever 620 is engaged with the engagement steps 530, 550 and 570 in a stepwise manner, primary locking, secondary locking or unlocking of the striker 100 is achieved. In addition, a second elastic member 730 is disposed at the rotation shaft 590 of the claw 500 to continuously urge the claw 500 toward the first insertion hole 210. Accordingly, the claw 500 is always urged toward the first insertion hole 210. In addition, the first elastic member 710 is disposed at the rotation shaft 640 of the lever assembly 600, as described above. Accordingly, the first elastic member 710 urges the release lever 630 and the pawl lever 620 toward the first insertion hole 210 and, as such, the pawl lever 620 and the claw 500 may maintain the striker 100 in a locked state.

In addition, an emergency handle 800 is rotatably disposed at the base 200 above the release lever 630. When the user opens the tailgate using a vehicle key, or when the tailgate is manually opened in accordance with operation of the emergency handle 800, the emergency handle 800 is rotated and, as such, an end portion of the emergency handle 800 presses the release lever 630, pivoting the release lever 630 without driving of the drive motor 300. As a result, the pawl lever 620 is separated from the claw 500, unlocking the striker 100.

A first detector 910 is disposed adjacent to the release lever 630. A second detector 930 is disposed adjacent to the claw 500. A third detector 950 is disposed adjacent to the main gear 400. The tailgate opening and closing device according to the exemplary embodiment of the present invention also includes a controller 900 configured for receiving positional signals from the first to third detectors 910, 930 and 950, and controlling the drive motor 300 based on the received positional signals. Upon determining insertion of the striker 100 into the first and second insertion holes 210 and 510, the controller 900 drives the drive motor 300, locking the striker 100 inserted into the first and second holes 210 and 510. Upon receiving signals from the first and second detectors 910 and 930, the controller 900 drives the drive motor 300 to perform a cinching operation. Upon subsequently receiving a signal from the first detector 910, the controller 900 performs a control operation to complete the cinching operation. Upon receiving a signal from the third detector 950 under the condition that separation of the striker 100 from the claw 500 has been completed, the controller 900 performs a control operation to return the set position of the main gear 400 to an original position through reverse rotation of the drive motor 300. That is, upon receiving a tailgate opening signal, the controller 900 drives the drive motor 300 to pivot the release lever 630 and, as such, the claw 500 rotates to unlock the striker 100.

Hereinafter, the tailgate opening and closing device according to the exemplary embodiment of the present invention will be described in more detail with reference to the accompanying drawings.

Figure 4:
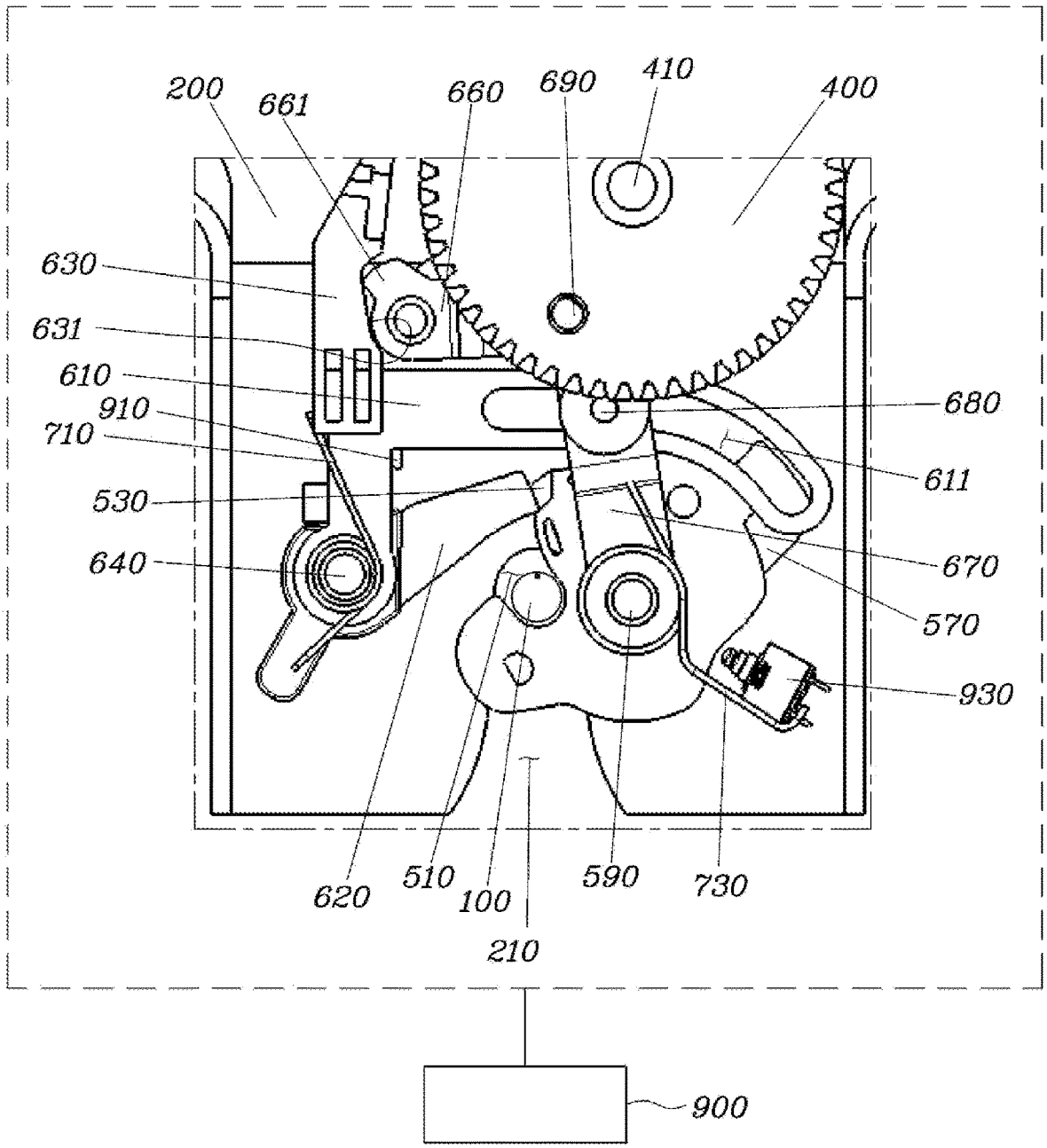
FIG. 4, FIG. 5, and FIG. 6 are views illustrating a release operation conducted through bidirectional rotation in a stepwise manner.
Figure 5:
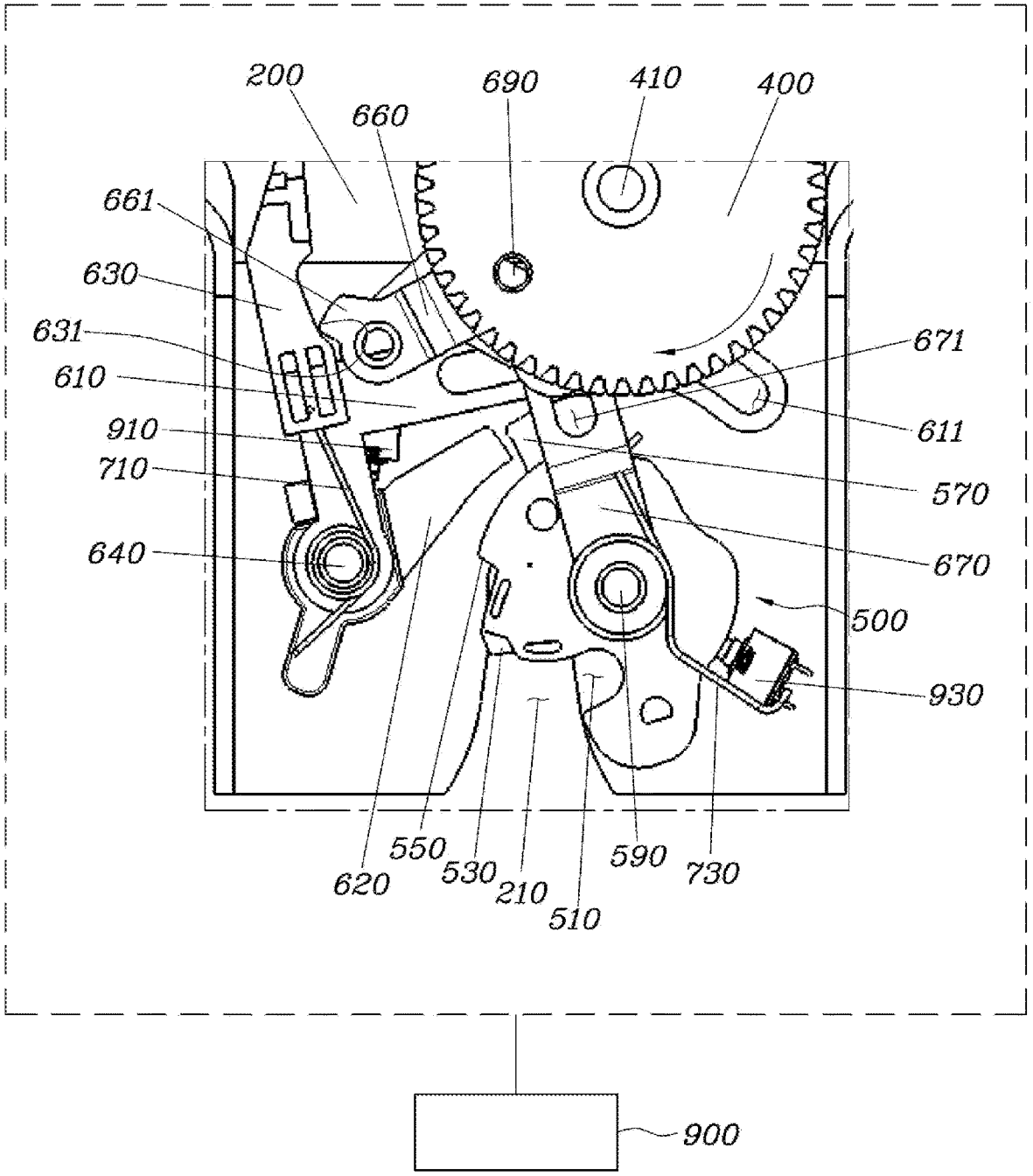
Figure 6:
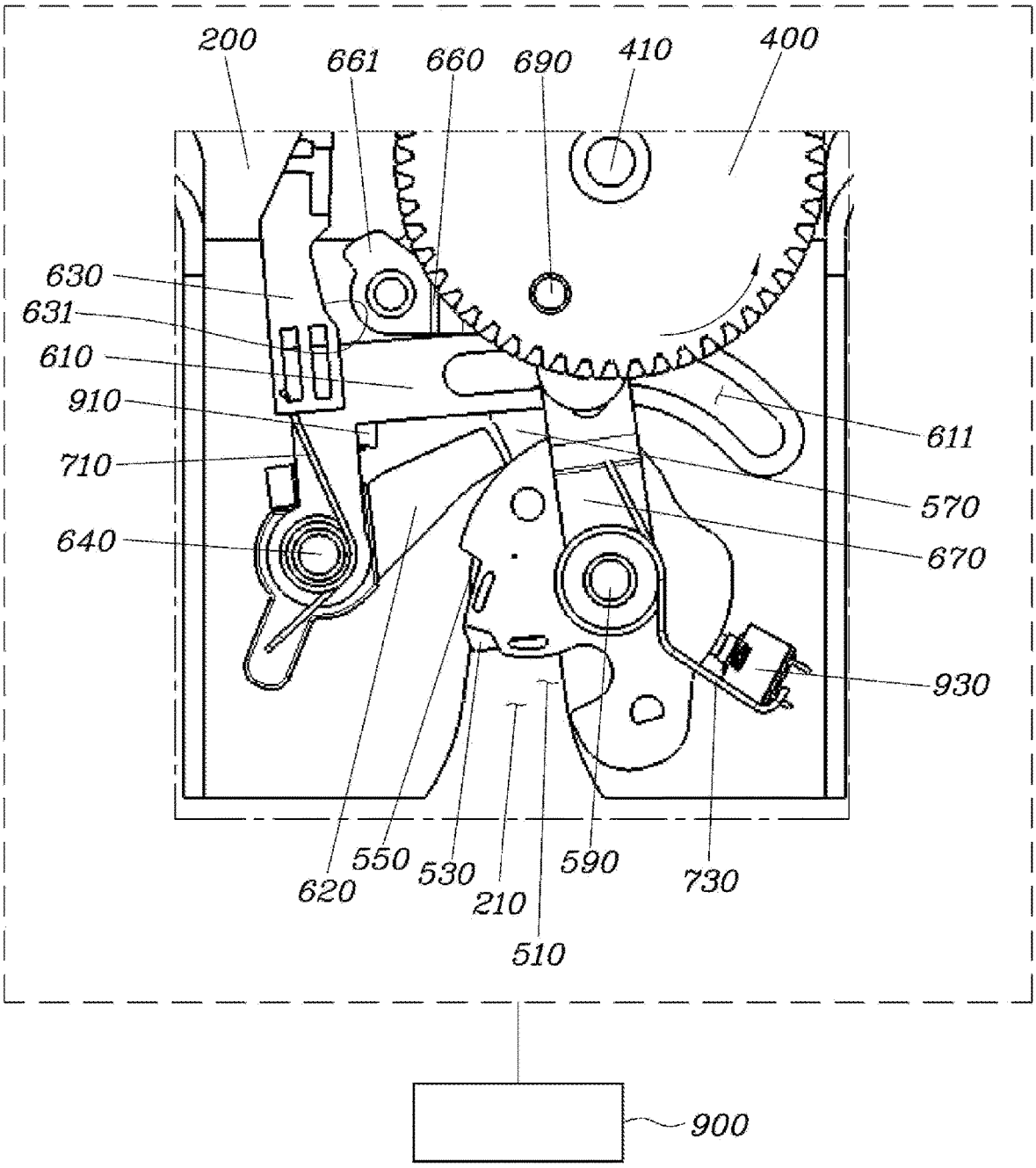

FIG. 4, FIG. 5, and FIG. 6 are views illustrating a release operation conducted through bidirectional rotation in a stepwise manner. FIG. 4 is a view illustrating a closed state of the tailgate. The engagement protrusion 661 of the second link 660 is in a state of being engaged with the engagement groove 631 of the release lever 630. In addition, the pawl lever 620 supports the first engagement step 530 of the claw 500 and, as such, the striker 100 is in a state of being locked by the claw 500 while being inserted into the first insertion hole 210 of the base 200 and the second insertion hole 510 of the claw 500.

When a tailgate opening signal is input to the controller 900 at the request of the user in the above-described locked state, the controller 900 sends a drive signal to the drive motor 300. As the drive motor 300 is driven, the main gear 400 rotates in a CW direction, as indicated by an arrow in FIG. 5 and, as such, the first link 650 rotates. In accordance with rotation of the first link 650, the engagement protrusion 661 of the second link 660 slides into the engagement groove 631 of the release lever 630 against an elastic force of the first elastic member 710. That is, as illustrated in FIG. 5, the engagement protrusion 661 is engaged with the engagement groove 631.

In the present case, the release lever 630 pivots about the rotation shaft 640 in a CCW direction away from the main gear 400. As a result, the error lever 610 and the pawl lever 620, which are mounted to the rotation shaft 640, pivot away from the claw 500. Accordingly, although the cinching pin 680 is in a stopped state, the error lever 610 pivots about the rotation shaft 640 by the first guide slit 611. The pawl lever 620 supported by the first engagement step 530 of the claw 500 is released and, as such, the claw 500 rotates in the CCW direction, causing the pawl lever 620 to be supported by the second engagement step 550. As a result, the second insertion hole 510 of the claw 500 is completely opened and, as such, the first insertion hole 210 is also opened, unlocking the striker 100. Thus, the tailgate is opened (FIG. 6).

After the tailgate is completely opened, the third detector 950 sends a signal to the controller 900. In response to the signal, the controller 900 drives the drive motor 300 in the CCW direction until the set position of the main gear 400 is recognized and, as such, the main gear 400 is returned to the original position. Thus, as the main gear 400 rotates in the CW direction and the CCW direction, as described above, the release operation is completed and, as such, the engagement protrusion 661 of the second link 660 is again maintained in a state of being engaged with the engagement groove 631 of the release lever 630.

Figure 7:
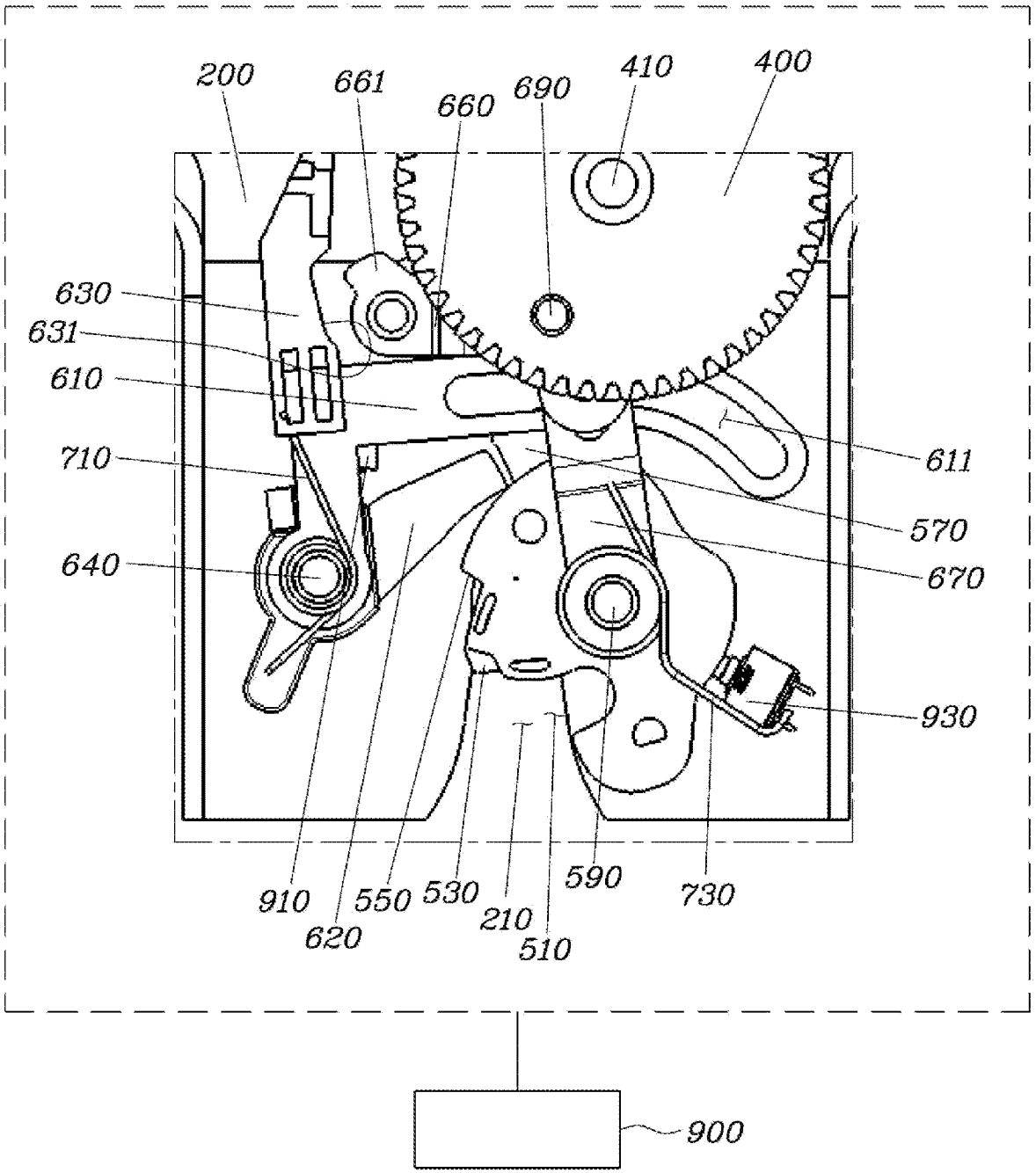
FIG. 7, FIG. 8, and FIG. 9 are views illustrating a cinching operation in a stepwise manner.
Figure 8:
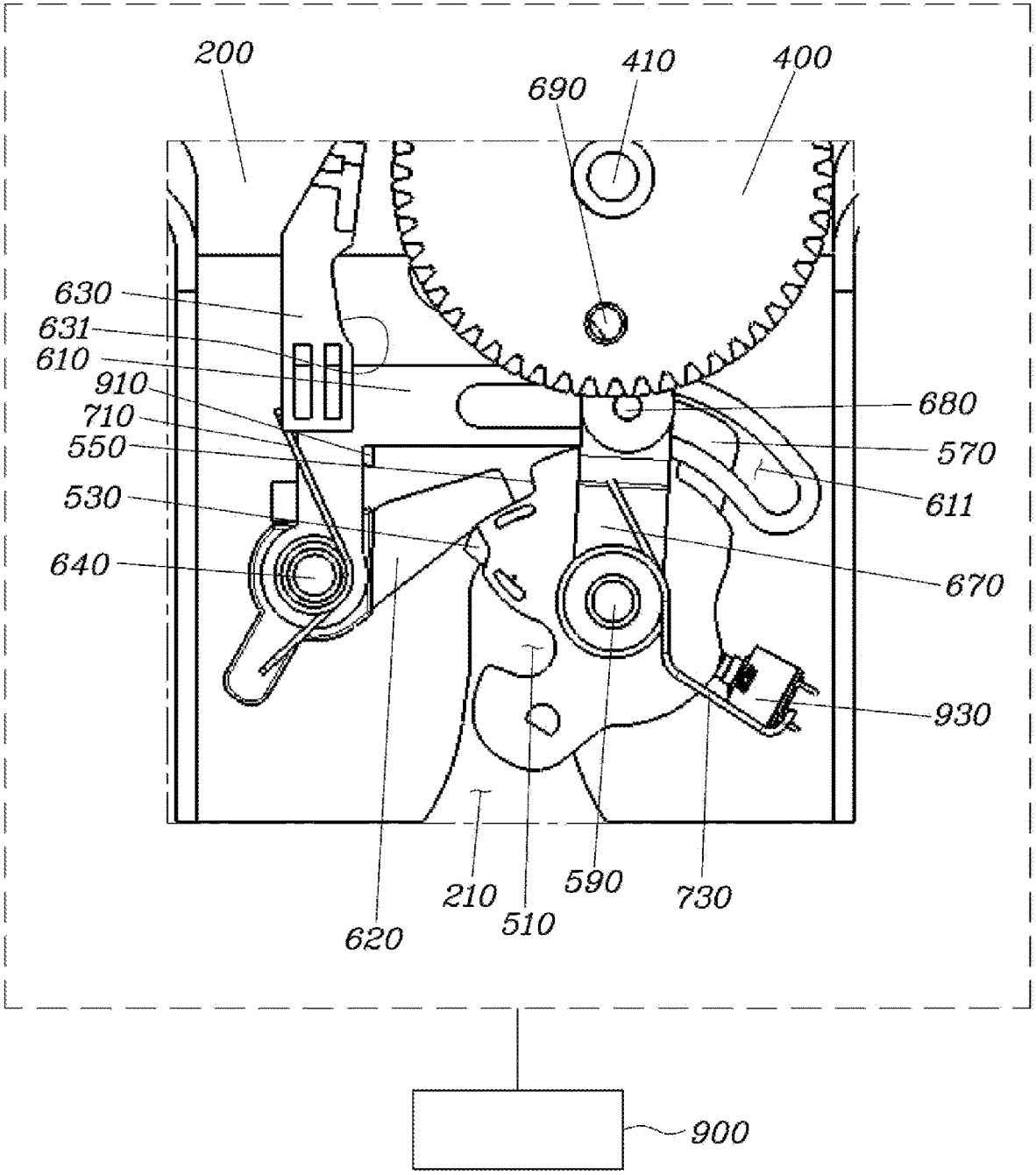
Figure 9:
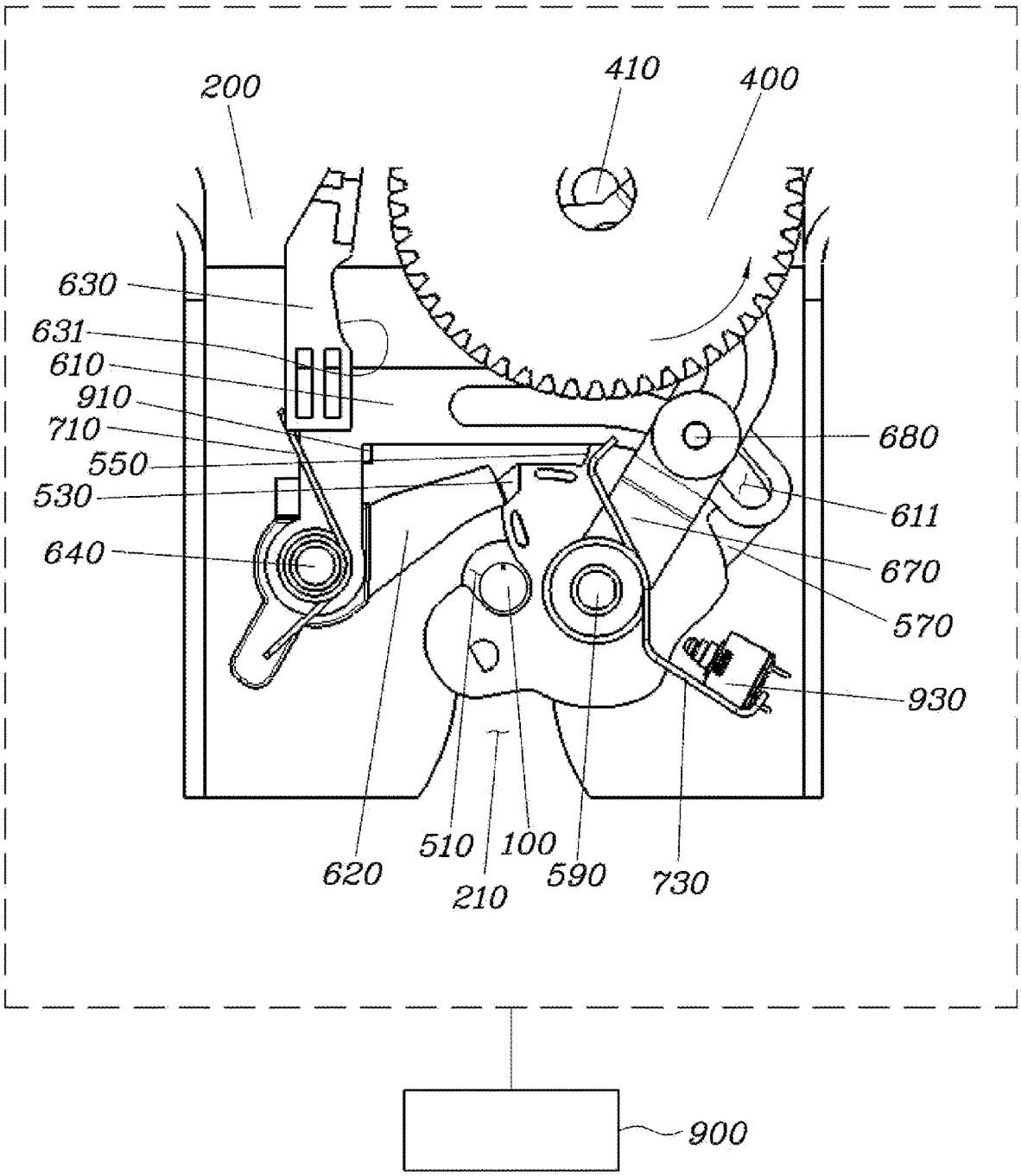

FIG. 7, FIG. 8, and FIG. 9 are views illustrating a cinching operation in a stepwise manner. FIG. 7 illustrates an opened state of the tailgate. The state of FIG. 7 is identical to the state of FIG. 6. When the user closes the tailgate by pressing the tailgate, the striker 100, which is mounted to a vehicle body, is inserted into the first insertion hole 210 of the base 200 and the second insertion hole 510 of the claw 500 while the tailgate pivots downwards. Subsequently, the striker 100 presses the claw 500. As a result, the claw 500 rotates in the CW direction by a pressing force applied thereto. In the present state, the cinching pin 680 is in a fixed state, but the error lever 610 slides by the first guide slit 611 and, as such, the pawl lever 620 is supported by the second engagement step 550 of the claw 500. The present state is referred to a primary locking state and illustrated in FIG. 8. As illustrated in FIG. 8, in the primary locking state, the cinching pin 680, which is slidable between the guide slits 611 and 671 of the error lever 610 and third link 670, is in contact with the third engagement step 570 of the claw 500.

In the primary locking state of FIG. 8, the controller 900 receives a cinching signals from the first detector 910 and the second detector 930. In response to the cinching signals, the controller 900 drives the drive motor 300 in the CCW direction. As the drive motor 300 is driven in the CCW direction, as illustrated in FIG. 9, the first link 650 rotates, and the second link 660 coupled to the other end portion of the first link 650 pivots the third link 670 mounted to the rotation shaft 590 of the claw 500 in a direction locking the claw 500. The cinching pin 680 slides continuously along the first guide slit 611 and the second guide slit 671, and the claw 500 rotates about the rotation shaft 590 in the CW direction and, as such, the claw 500 achieves a secondary locking state. When the first detector 910 sends a signal to the controller 900 in the present state, the controller 900 stops driving of the drive motor 300. Thus, cinching is completed.

Figure 10:
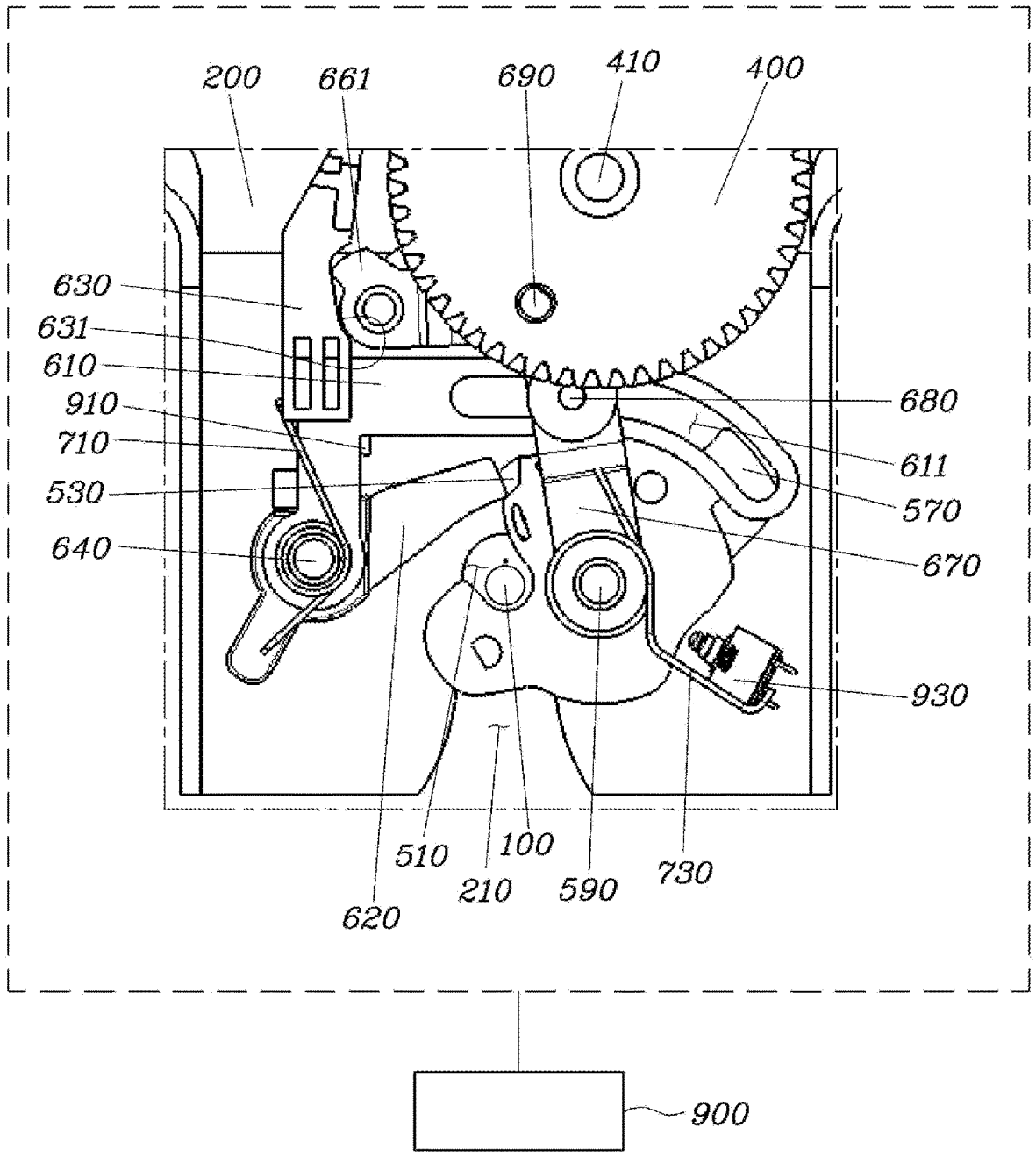
FIG. 10, FIG. 11, and FIG. 12 are views illustrating an interrupt operation in a stepwise manner.
Figure 11:
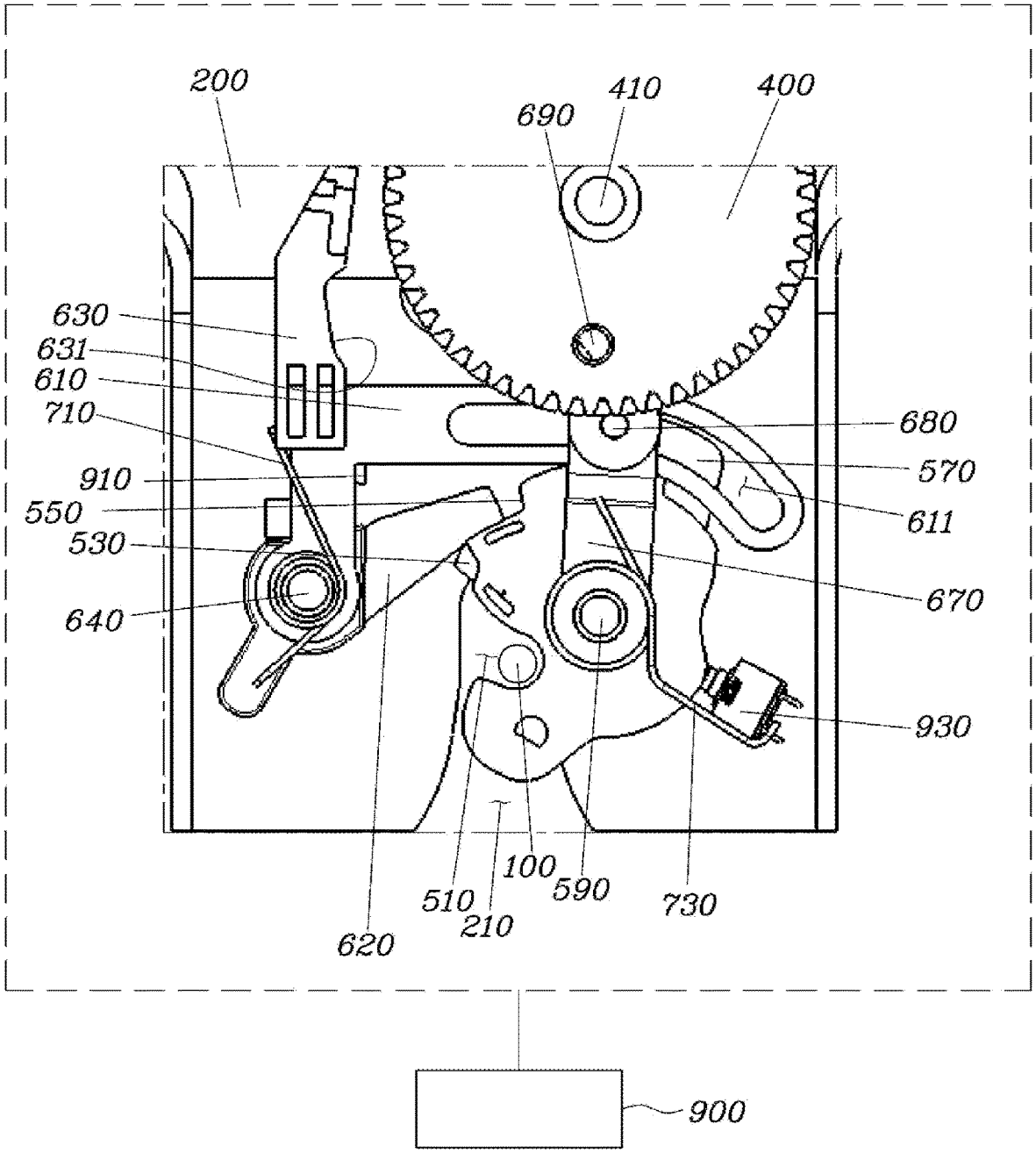
Figure 12:
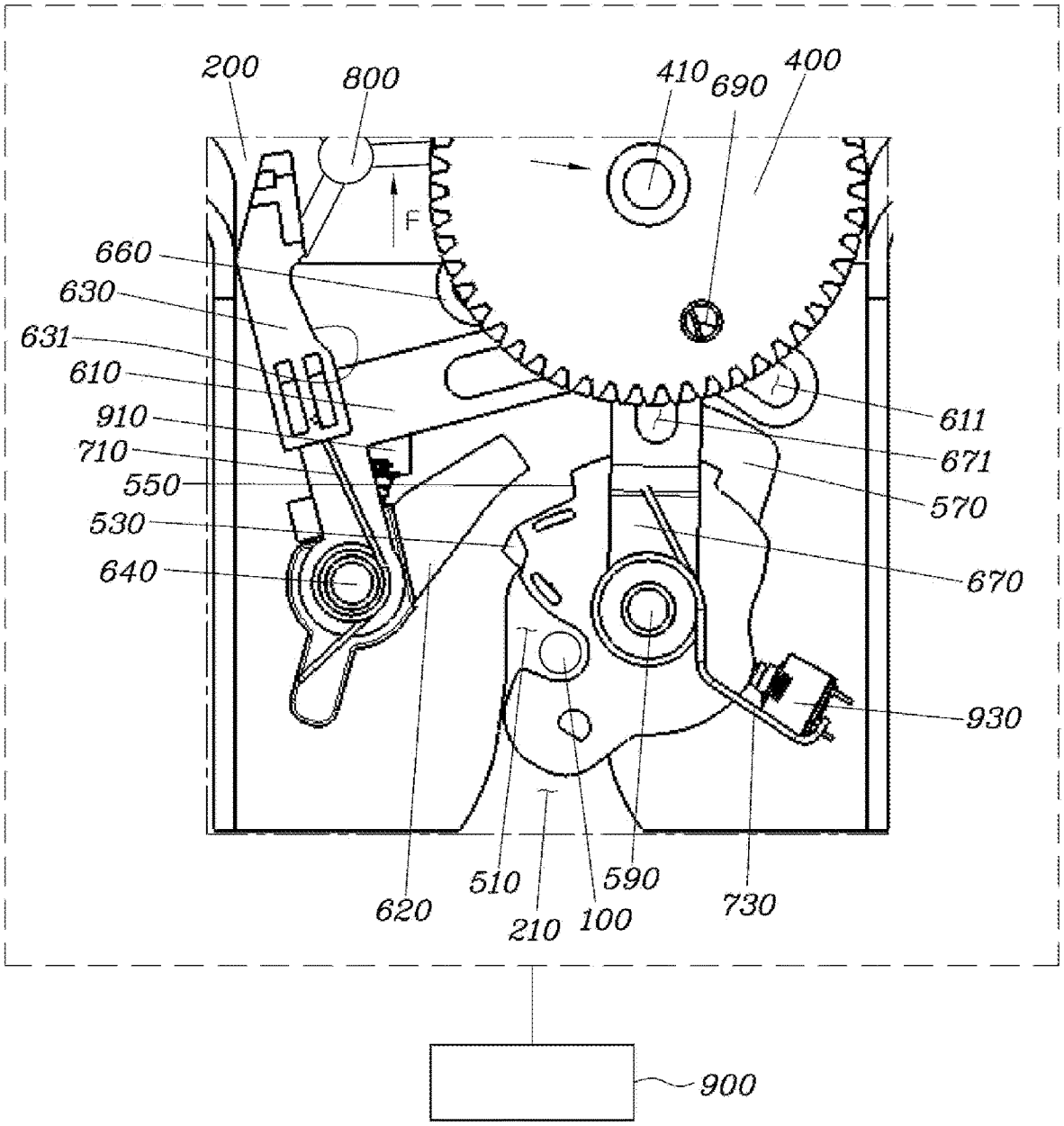

FIG. 10, FIG. 11, and FIG. 12 are views illustrating an interrupt operation in a stepwise manner. FIG. 10 is a view illustrating a state in which primary locking is conducted. FIG. 11 is a view illustrating a state in which secondary locking is conducted. When the user opens the tailgate using a vehicle key during cinching or when the tailgate is manually opened in accordance with operation of the emergency handle 800, the release lever 630 is pulled by a wire 850, to open the tailgate. The controller 900 determines the present state as an interrupt situation.

When the controller 900 determines that an interrupt situation has occurred, the controller 900 stops driving of the drive motor 300 conducted during cinching. In the present state, the emergency handle 800 operates to pivot the release lever 630 in a direction away from the claw 500. As a result, the error lever 610 and the pawl lever 620, which are mounted to the same rotation shaft, namely, the rotation shaft 640, pivot and, as such, the pawl lever 620 supporting the claw 500 moves away from the claw 500. Accordingly, the striker 100 is separated from the first insertion hole 210 of the base 200 and the second insertion hole 510 of the claw 500. Thus, unlocking is achieved.

Figure 13:
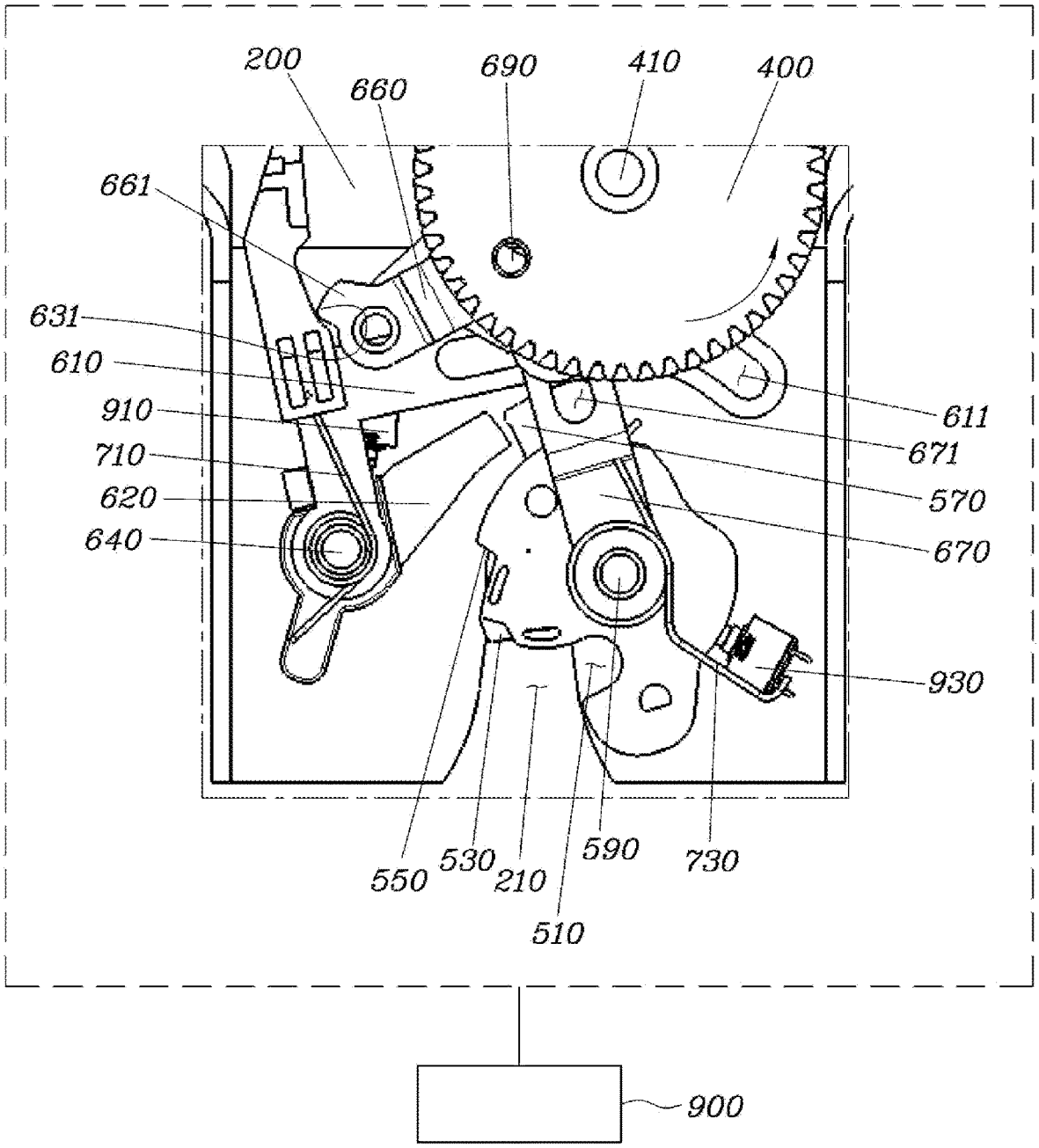
FIG. 13 is a view illustrating rotation conducted in one direction during the release operation.

FIG. 13 is a view illustrating rotation conducted in one direction during the release operation. FIG. 13 illustrates a release operation conducted as the main gear 400 rotates in one direction, differently than a release operation conducted in accordance with bidirectional rotation of the main gear 400 as illustrated in FIG. 4, FIG. 5, and FIG. 6.

FIG. 13 is a view illustrating a closed state of the tailgate. In the present state, the engagement protrusion 661 of the second link 660 is engaged with the engagement groove 631 of the release lever 630, and the pawl lever 620 is supported by the first engagement step 530 of the claw 500. Accordingly, the striker 100 is in a state of being locked by the claw 500 while being inserted into the first insertion hole 210 of the base 200 and the second insertion hole 510 of the claw 500.

When a tailgate opening signal is input to the controller 900 at the request of the user in the above-described locked state, the controller 900 sends a drive signal to the drive motor 300. As the drive motor 300 is driven, the main gear 400 rotates in the CCW direction, as illustrated in FIG. 13 and, as such, the first link 650 rotates. In accordance with rotation of the first link 650, the engagement protrusion 661 of the second link 660 slides into the engagement groove 631 of the release lever 630 against an elastic force of the first elastic member 710. That is, the engagement protrusion 661 is engaged with the engagement groove 631, as illustrated in FIG. 13.

In the present case, the release lever 630 pivots about the rotation shaft 640 in a direction away from the main gear 400, that is, the CCW direction. As a result, the error lever 610 and the pawl lever 620, which are mounted to the same rotation shaft, namely, the rotation shaft 640, pivot away from the claw 500. Accordingly, although the cinching pin 680 is in a stopped state, the error lever 610 pivots about the rotation shaft 640 by the first guide slit 611. The pawl lever 620 supported by the first engagement step 530 of the claw 500 is released and, as such, the claw 500 rotates in the CCW direction, causing the pawl lever 620 to be supported by the second engagement step 550. As a result, the second insertion hole 510 of the claw 500 is completely opened and, as such, the first insertion hole 210 is also opened, unlocking the striker 100. Thus, the tailgate is opened (FIG. 13).

After the tailgate is completely opened, the third detector 950 sends a signal to the controller 900. In response to the signal, the controller 900 drives the drive motor 300 in the CCW direction until the set position of the main gear 400 is recognized and, as such, the main gear 400 is returned to the original position. Thus, as the main gear 400 rotates in one direction, namely, the CCW direction, as described above, the release operation is completed and, as such, the engagement protrusion 661 of the second link 660 is again maintained in a state of being engaged with the engagement groove 631 of the release lever 630.

During the release operation, it may be possible to send the tailgate opening signal to the controller 900 by operating a button disposed in a passenger compartment by the user. When the button is operated, the wire 850 is pulled, achieving the primary locking state of the tailgate. Once the primary locking state of the tailgate is achieved, the main gear 400 rotates in accordance with driving of the drive motor 300, to achieve complete opening of the tailgate. Otherwise, release may be conducted in accordance with driving of the drive motor 300 alone.

Thus, the above-described tailgate opening and closing device has a cinching-integrated power latch structure, in detail, a cinching-integrated structure using a link assembly with a main gear, and, as such, it may be possible to achieve a reduction in the number of constituent elements, a reduction in cost and a reduction in weight through structural simplification. In addition, by the cinching-integrated structure, loss of operating power is reduced. Since the main gear is rotatable in the CW direction or in the CCW direction, bidirectional release may be achieved. As a result, an enhancement in product quality may be achieved.

For convenience in explanation and accurate definition in the appended claims, the terms "upper", "lower", "internal", "outer", "up", "down", "upwards", "downwards", "front", "back", "rear", "inside", "outside", "inwardly", "outwardly", "internal", "external", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilizer various exemplary embodiments of the present invention, as well as various alternatives and modifications thereof. It is intended that the scope of the invention be defined by the Claims appended hereto and their equivalents.

What is claimed is:

1. A tailgate opening and closing device for a vehicle, the tailgate opening and closing device comprising:

a base formed, at a first side thereof, with a first insertion hole into or from which a striker is configured to be inserted or withdrawn;

a main gear disposed at a second side of the base while being rotatable by a drive motor;

a claw rotatably disposed at a side of the first insertion hole of the base while being formed with a second insertion hole configured for receiving the striker, to lock the striker when the striker is inserted into the first insertion hole and the second insertion hole; and a lever assembly including an error lever disposed adjacent to the main gear and the claw while extending across between the main gear and the claw, a pawl lever for locking or unlocking the claw, and a release lever connected to the error lever and the pawl lever while being pivotable about a rotation shaft of the release lever, wherein the error lever is formed with a first guide slit extending in a longitudinal direction of the error lever, wherein a third link is disposed at a rear side of the error lever, wherein the third link is bent from the release lever to a rotation shaft of the claw, wherein the third link is formed, at an inside thereof, with a second guide slit extending in a longitudinal direction of the third link, wherein a cinching pin is slidably coupled to the first guide slit of the error lever and the second guide slit of the third link, to extend through both the first guide slit and the second guide slit, and wherein the cinching pin slides along the first guide slit and the second guide slit during operation of the lever assembly, to pivot the release lever and to rotate the claw, locking or unlocking the striker.

2. The tailgate opening and closing device according to claim 1, wherein the drive motor is mounted to the second side of the base at a position adjacent to the main gear, and a worm gear is provided at the drive motor, to rotate the main gear during driving of the drive motor.

3. The tailgate opening and closing device according to claim 1, wherein the lever assembly further includes a first link mounted to a rotation shaft, to which the main gear is mounted, and wherein the first link rotates during rotation of the main gear, and a second link disposed to be engaged with or disengaged from the release lever at a first end portion thereof while being pivotably coupled, at a second end portion thereof, to the first link, forming a coupler to pivot the second link during rotation of the first link.

4. The tailgate opening and closing device according to claim 3, wherein the release lever is formed with an engagement groove recessed inwardly of the release lever at a surface of the release lever facing the second link, and the second link is formed, at a first side thereof, with an engagement protrusion to be engagable with the engagement groove, and wherein the engagement protrusion of the second link is selectively inserted into or engaged with, or disengaged from the engagement groove in accordance with an operation of the second link conducted when the main gear rotates during driving of the drive motor.

5. The tailgate opening and closing device according to claim 4, wherein the second link is bent in forward and rearward directions of the base at a center portion thereof, to form a stepped structure, and wherein the second end portion of the second link is lower than the first end portion of the second link with respect to the base, and the second end portion of the second link is coupled to a front portion of the error lever.

6. The tailgate opening and closing device according to claim 1, wherein the pawl lever extends toward the claw while being pivotably mounted to the release lever at a lower side of the release lever, and the error lever is pivotably mounted to the rotation shaft of the release lever while extending toward the release lever by a predetermined length and then being bent to extend transversally between the main gear and the claw, and wherein the pawl lever and the error lever pivot simultaneously about the rotation shaft of the release lever while maintaining a constant distance therebetween, to lock or unlock the claw.

7. The tailgate opening and closing device according to claim 1, wherein a first elastic member is disposed at the rotation shaft of the release lever to continuously urge the release lever toward the claw.

8. The tailgate opening and closing device according to claim 1, wherein the claw has a first engagement step, a second engagement step and a third engagement step, which are formed along an external peripheral surface of the claw, and wherein the pawl lever is engaged with the first, second and third engagement steps sequentially, achieving primary locking, secondary locking or unlocking of the striker.

9. The tailgate opening and closing device according to claim 1, wherein a second elastic member is disposed at the rotation shaft of the claw to continuously urge the claw toward the first insertion hole.

10. The tailgate opening and closing device according to claim 1, wherein an emergency handle is rotatably disposed at the base above the release lever, and wherein when the emergency handle rotates in accordance with an operation thereof, an end portion of the emergency handle presses the release lever, pivoting the release lever, causing the pawl lever to be spaced away from the claw, for unlocking of the striker.

11. The tailgate opening and closing device according to claim 1, further including:

a first detector disposed adjacent to the release lever;

a second detector disposed adjacent to the claw;

a third detector disposed adjacent to the main gear; and a controller configured for receiving positional signals from the first, second and third detectors, and controlling the drive motor based on the received positional signals, the controller driving the drive motor upon determining insertion of the striker into the first and second insertion holes, locking the striker inserted into the first and second holes.

12. The tailgate opening and closing device according to claim 11, wherein the controller drives the drive motor to perform a cinching operation, upon receiving signals from the first and second detectors, and performs a control operation to complete the cinching operation, upon subsequently receiving a signal from the first detector.

13. The tailgate opening and closing device according to claim 11, wherein, upon receiving a signal from the third detector when separation of the striker from the claw has been completed, the controller performs a control operation to return a set position of the main gear to an original position through a reverse rotation of the drive motor.

14. The tailgate opening and closing device according to claim 11, wherein, upon receiving a tailgate opening signal, the controller drives the drive motor to pivot the release lever, rotating the claw, for unlocking of the striker.

* * * * *